US009534750B2

(12) United States Patent
Pritchett

(10) Patent No.: US 9,534,750 B2
(45) Date of Patent: Jan. 3, 2017

(54) MULTI-DIRECTIONAL FLASHLIGHT

(76) Inventor: Ronnie Pritchett, Ramona, CA (US)

( * ) Notice: Subject to any disclaimer, the term of this patent is extended or adjusted under 35 U.S.C. 154(b) by 0 days.

(21) Appl. No.: 13/473,173

(22) Filed: May 16, 2012

(65) Prior Publication Data

US 2013/0308307 A1 Nov. 21, 2013

(51) Int. Cl.

| | |
|---|---|
| ***F21V 7/00*** | (2006.01) |
| ***F21L 4/02*** | (2006.01) |
| ***H05B 33/08*** | (2006.01) |
| *F21V 5/00* | (2015.01) |
| *F21Y 101/00* | (2016.01) |

(52) U.S. Cl.

CPC ..... *F21L 4/027* (2013.01); *F21V 7/0075* (2013.01); *H05B 33/0806* (2013.01); *H05B 33/0845* (2013.01); *F21V 5/006* (2013.01); *F21Y 2101/00* (2013.01)

(58) Field of Classification Search

CPC ... F21Y 2101/02; F21Y 2103/003; F21L 4/02; F21L 4/00; F21L 4/027; F21L 4/08; F21L 4/005; F21L 4/022; F21L 7/0075

USPC ..... 362/184, 185

See application file for complete search history.

(56) References Cited

U.S. PATENT DOCUMENTS

| | | | | |
|---|---|---|---|---|
| 5,077,644 | A | 12/1991 | Schaller et al. | |
| 5,353,208 | A * | 10/1994 | Moore | F21L 4/005 362/202 |
| 5,580,156 | A * | 12/1996 | Suzuki | B60Q 7/00 116/63 P |
| 5,630,661 | A | 5/1997 | Fox | |
| 7,214,952 | B2 | 5/2007 | Klipstein et al. | |
| 7,387,402 | B1 | 6/2008 | Lui (Phillip) | |
| 2003/0184999 | A1* | 10/2003 | Neiser | F21L 4/027 362/184 |
| 2004/0190286 | A1* | 9/2004 | Chapman | 362/171 |
| 2005/0007777 | A1* | 1/2005 | Klipstein et al. | 362/244 |
| 2005/0088843 | A1 | 4/2005 | Chapman | |
| 2007/0153512 | A1 | 7/2007 | Hendrie | |
| 2007/0159816 | A1* | 7/2007 | Bayat | F21L 4/027 362/184 |
| 2007/0177378 | A1* | 8/2007 | Wu et al. | 362/184 |
| 2007/0258235 | A1* | 11/2007 | Brockel et al. | 362/190 |
| 2008/0180946 | A1 | 7/2008 | Kim et al. | |
| 2008/0205036 | A1* | 8/2008 | Tarter et al. | 362/105 |
| 2009/0189541 | A1 | 7/2009 | Crawford et al. | |
| 2010/0254122 | A1* | 10/2010 | Bayat | F21L 4/027 362/187 |

FOREIGN PATENT DOCUMENTS

| | | |
|---|---|---|
| DE | 20004105 U1 | 5/2000 |
| DE | 20206201 U1 | 8/2002 |

(Continued)

OTHER PUBLICATIONS

International Search Report dated Jul. 31, 2013 for International Application No. PCT/US2013/041472 filed May 16, 2013.

(Continued)

*Primary Examiner* — Sean Gramling
*Assistant Examiner* — Gerald J Sufleta, II
(74) *Attorney, Agent, or Firm* — Snell & Wilmer L.L.P.

(57) ABSTRACT

There is provided a hand held flashlight having different intensity and direction of projected light controlled by switches which function independently or pently.

19 Claims, 3 Drawing Sheets

(56) References Cited

FOREIGN PATENT DOCUMENTS

| | | | |
|---|---|---|---|
| WO | 2005057080 | A2 | 6/2005 |
| WO | 2008157772 | A1 | 12/2008 |

OTHER PUBLICATIONS

Written Opinion of the International Searching Authority dated Aug. 7, 2013 for International Application No. PCT/US2013/041472 filed May 16, 2013; total 12 pages.

International Preliminary Report on Patentability dated Nov. 18, 2014 for International Application No. PCT/US2013/041472 filed May 16, 2013; total 13 pages.

* cited by examiner

MULTI-DIRECTIONAL FLASHLIGHT

FIELD OF THE INVENTION

The present invention relates to a hand held flashlight having a different direction and intensity of projected light. More particular, there is provided a flashlight which comprises multidirectional and intensity stationary light emitting source.

BACKGROUND OF THE INVENTION

Traditional flashlights are normally provided with a reflector having rotational symmetry. That is, the reflector has a shaped formed by rotating a generatrix along the longitudinal axis passing through the bulb of the flashlight.

U.S. Pat. No. 7,387,402 discloses a multiple lens LED flashlight which provides one or more wide angle projections of light as well as a concentrated light beam. Sets of LEDs are mounted to separate circuit boards.

U.S. Pat. No. 5,630,661 discloses a flashlight utilizing halogen lamps having variable fields of illumination with adjustably positioned lens.

SUMMARY OF THE INVENTION

According to the invention there is provided a flashlight comprising at least three light emitting bulbs within reflectors which direct light either to the sides or to the front where the light can also be emitted in at least 180 degrees. A dimmer switch for each bulb is provided whereby the light intensity is controlled for each bulb depending upon a direction required to be used.

It is therefore a general object of the invention to provide a flashlight which has multiple directions of light emission and intensity.

It is a further object of the invention to provide a flashlight which emits light to one or two sides.

It is another object of the invention to provide a flashlight with reflectors that captures and redirects light in a preselected beam.

These and other objects and advantages will become apparent from a reading of the preferred embodiments together with the drawings.

DESCRIPTION OF THE PREFERRED EMBODIMENTS

Figure 1:
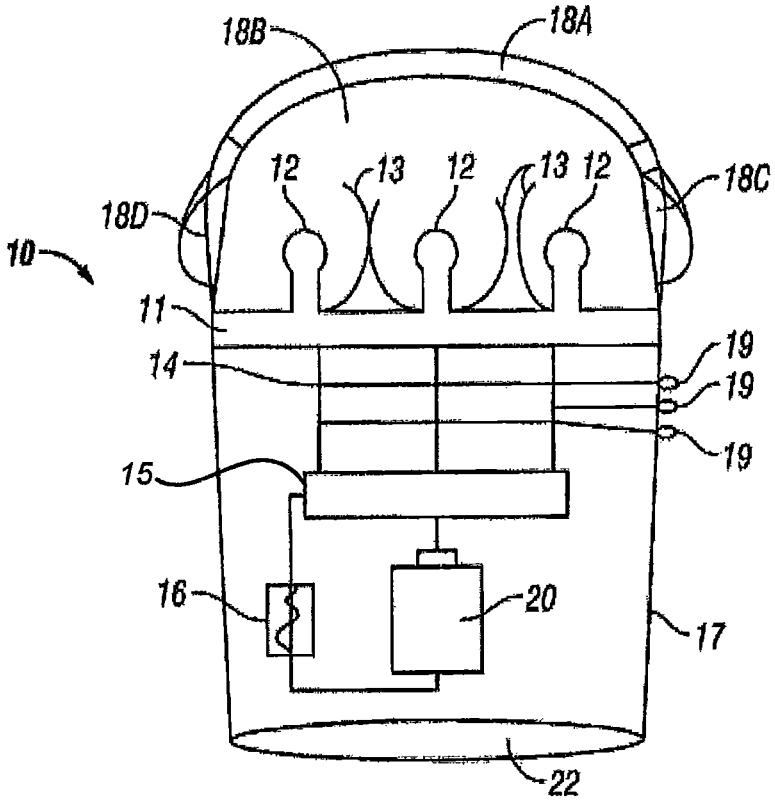
FIG. 1 is a top elevation in cross-section of the flashlight of the invention.

With reference to FIG. 1 there is provided a flashlight (10) comprising a tubular housing (21) made of any suitable material, such as but not limited to plastic or aluminum. The illustrated elongated housing extends between a large end (18) and a small removable end or cover (22).

At the large end (18) is a transparent cover (18A) defining a chamber (18B) sized and configured to receive a bulb housing (11) which contains at least three light emitting bulbs (12) which can have an incandescent filament or preferably light emitting diodes (LEDs). The LEDs can have any size, shape and color. The bulbs (12) are each housed in reflectors (13). The reflectors (13) extend upwardly around the bulbs (12) to form a socket for the bulbs (12). The two side reflectors direct light to the sides and the middle reflector (13) directs light to the front so that the light is emitted when all three bulbs (12) are activated and the light is emitted at least 180 degrees. The reflectors (13) may be in the shape of a paraboloid or other similar shape to capture and redirect light from a bulb in a preselected beam.

The bulb housing (11) may be removable to provide access to the battery (20).

The bulbs (12) may be at an angle with respect to the reflector (13) or the reflector may be shaped to capture substantially all the light produced by the bulb and redirect it toward a direction in a predetermined pattern.

The reflector is made typically from a plastic material which is coated on at least one surface with a light-reflecting material such as silver, aluminum or other similar material.

A standard electronic ballast (15) is provided for converting battery voltage from the battery through a dimmer switch (16) to the bulbs (12). Alternatively there is provided a dimmer switch for each of the bulbs (12) so that the intensity of light emitted can vary with each bulb.

Electrical circuitry (14) is provided for connecting the electronic ballast (15) to the bulbs (12) and the ballast to the electrical contact with the battery. The circuitry delivers electrical energy from the power source through the dimmer switch(es) to the light generating assembly. The circuitry in combination with the ballast delivers electrical energy from the power source to the light generating assembly. The circuitry (14) includes on and off switch(es) for controlling the flow of electricity from the battery to the ballast. External electrical input jacks (not shown) may be provided to effect recharging of the battery.

External switches (19) are provided for each of the bulbs.

As seen in FIG. 1 the circuitry (14) can be provided with a single dimmer switch (16) which controls the intensity of light emitted from all the bulbs (12). Also there are external switches (19) which activate or deactivate the bulbs (12).

Figure 2:
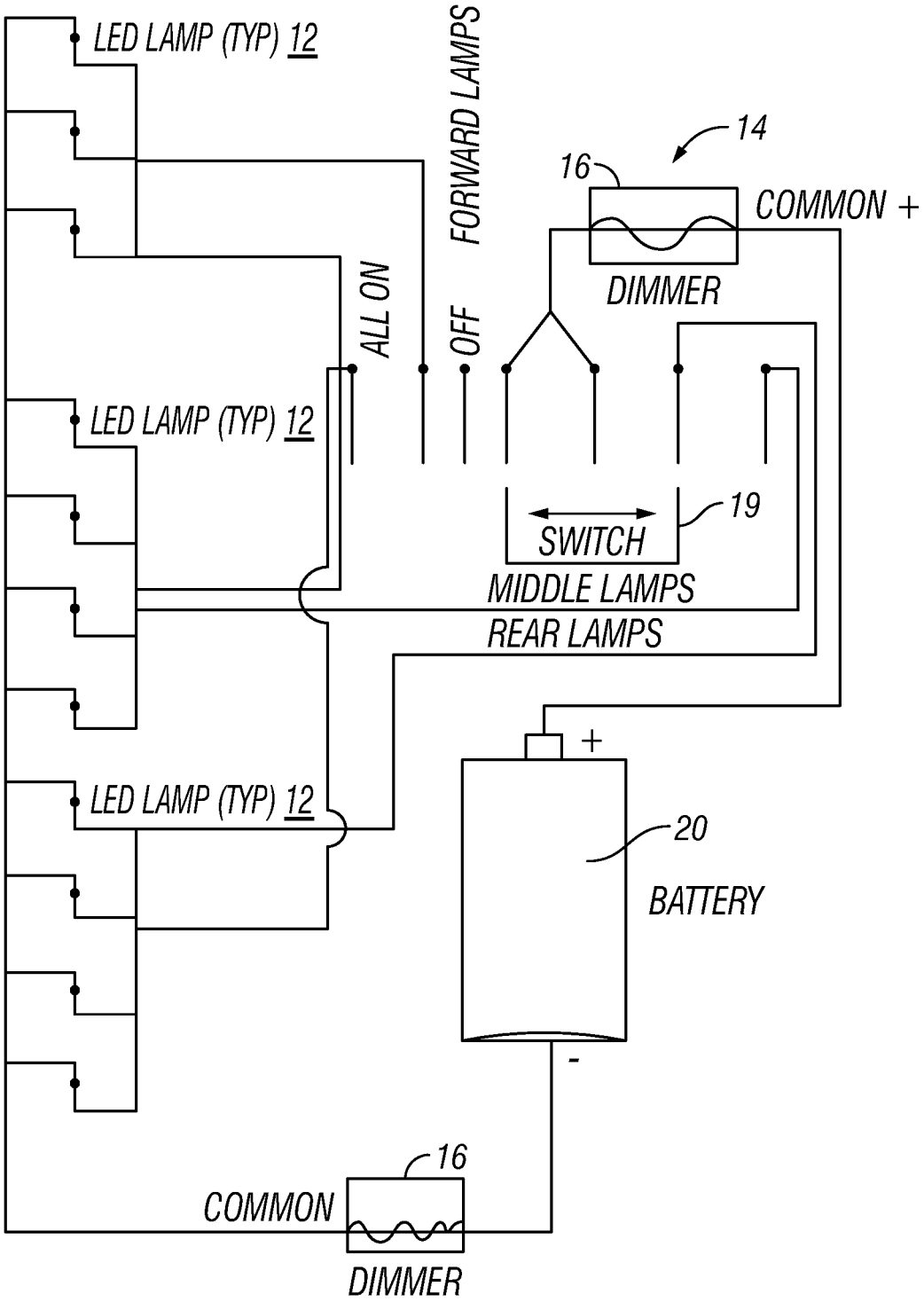
FIG. 2 is a circuit diagram wherein a dimmer controls all three bulbs in the invention.
Figure 3:
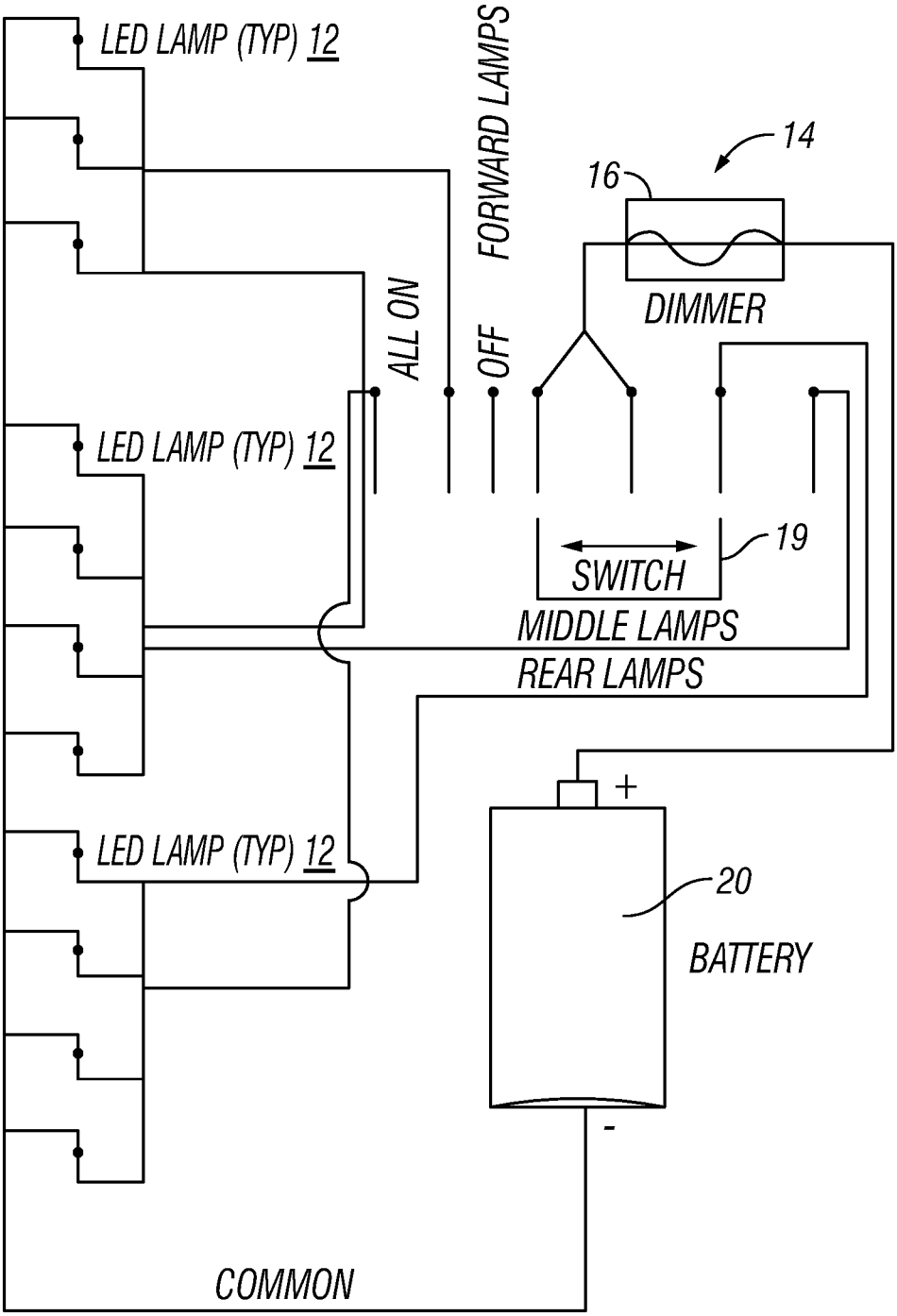
FIG. 3 is a circuit diagram wherein each bulb is controlled by a dimmer switch.

As shown in FIG. 2, the circuitry (14) comprises a dimmer switch (16) that controls the intensity of the electricity to each bulb so as to vary the degree of light intensity to each of the bulbs (12). This allows either side bulbs to be activated for viewing only the sides without light diffused from the center bulb which may interfere with sight.

The lens (18A) may comprise convex existing lens which act with the reflectors to form a concentrated light beam to each side and front of the flashlight.

Although the present invention has been described in terms of certain embodiments, other embodiments apparent to those of ordinary skill in the art also are within the scope of this invention. Thus, various changes and modifications may be made without departing from the spirit and scope of the invention. For instance, various components may be repositioned as desired. Moreover, not all of the features, aspects and advantages are necessarily required to practice the present invention. Accordingly, the scope of the present invention is intended to be defined only by the claims that follow.

What is claimed is:

1. A flashlight having a variable field of illumination comprising:

an elongated tubular housing extending between first and second opposed ends and comprising an internal cavity for accommodating one or more batteries therein;

a multiple bulb housing disposed at the housing second end;

a transparent cover disposed over the multiple bulb housing, the cover having a convex shape defined by a front section and opposed side sections, wherein a chamber is defined between the multiple bulb housing and the cover, the chamber having a convex-shaped top section;

a bulb assembly connected with the multiple bulb housing and extending outwardly away from an open end of the multiple bulb housing, wherein the bulb assembly is positioned within the chamber and comprises at least three light emitting bulbs operatively connected with the one or more batteries, wherein each light emitting bulb is housed within a respective reflector and the respective light emitting bulb and reflector project outwardly away from the multiple bulb housing open end, whereby one reflector is configured to direct light emitted from the respective bulb outwardly from a first side of the multiple bulb housing through a first side section of the cover, whereby another reflector is configured to direct light emitted from the respective bulb outwardly from a second side of the multiple bulb housing opposite the first side through a second side section of the cover opposite the cover first side section, and another reflector is configured to direct light emitted from the respective bulb outwardly from a front portion of the multiple bulb housing through the front section of the cover to provide a field of illumination of at least 180 degrees outwardly from the multiple bulb housing and through the transparent cover, and wherein the transparent cover opposed first and second side sections each extend downwardly from the cover front section to the multiple bulb housing open end; and a switch connected to the housing to activate said bulbs.

2. The flashlight of claim 1 wherein said bulbs are LEDs.

3. The flashlight of claim 1 wherein said bulbs are with an incandescent filament.

4. The flashlight of claim 1 further comprising a dimmer switch that controls the intensity of light transmission of at least one bulb.

5. The flashlight of claim 1 wherein said reflectors inhibit the vertical diffusion of light.

6. The flashlight of claim 1 wherein each bulb is provided with a dimmer switch which is independent of any other dimmer switches.

7. The flashlight of claim 1 wherein said transparent cover comprises a unitary construction of the front section and the side sections.

8. The flashlight of claim 7 where said transparent cover further comprises convex portions positioned along the side sections to concentrate light emitted from the light bulbs and the reflectors disposed along the first and second opposed sides of the multiple bulb housing outwardly through the transparent cover.

9. A flashlight comprising:

an elongate housing extending between opposed ends wherein one of the ends is open and the other of the ends is closed, wherein the housing comprises a cavity disposed therein for accommodating one or more batteries;

a bulb assembly connected with the housing and comprising a number of light bulbs electrically connected with the one or more batteries, the bulb assembly comprising reflectors that are configured to orient light emitted by the light bulbs in a forward direction and in opposed side directions outwardly from the housing, wherein the bulb assembly projects outwardly from an end of the housing such that light emitted from the bulbs and respective reflectors at opposed side positions in the bulb assembly passes outwardly from the bulb assembly and flashlight in diametrically opposed directions; and a unitary transparent cover disposed over the bulb assembly for enabling the light emitted by the light bulbs to pass outwardly from the housing to provide a field of illumination that is 180 degrees.

10. The flashlight as recited in claim 9 wherein the transparent cover has a convex shape with a front section and two opposed side sections each extending from the front section to the end of the housing adjacent the bulb assembly.

11. The flashlight as recited in claim 10 wherein the bulb assembly is disposed within a chamber defined by the end of the housing adjacent the bulb assembly and an inside surface of the transparent cover.

12. A flashlight comprising:

a housing extending between a first closed end and an opposed second end, the housing defining a chamber for accommodating one or more batteries therein;

a bulb assembly extending outwardly and away from the housing second end, and comprising a number of light emitting bulbs and reflectors, wherein one light emitting bulb and reflector is positioned at a first side of the bulb assembly to direct light emitted therefrom outwardly from the flashlight to provide a first field of illumination, wherein another light emitting bulb and reflector is positioned at a second side of the bulb assembly opposite the first side to direct light emitted therefrom outwardly from the flashlight to provide a second field of illumination that is directed at least 180 degrees away from the first field of illumination, and wherein one light emitting bulb and reflector is positioned adjacent a center of the bulb assembly to direct light emitted therefrom outwardly from the flashlight to provide a third field of illumination that is between the first and second fields of illumination;

a transparent cover that is disposed over the bulb assembly and that has a convex shape forming a chamber that accommodates the bulb assembly therein.

13. The flashlight as recited in claim 12 wherein the transparent cover comprises a front section and opposed side sections each extending away from the front section to the housing.

14. The flashlight as recite in claim 12 wherein the third field of illumination provides fills between the first and second fields of illumination so that the flashlight provides an overall field of illumination that is at least 180 degrees.

15. The flashlight as recited in claim 13 wherein the transparent lens front section and at least a portion of the opposed side sections are of approximately the same thickness.

16. The flashlight as recited in claim 1 wherein the light emitted from the bulb assembly passes outwardly from the first and second sides of the multiple bulb housing in a manner that is not obscured by the tubular housing.

17. The flashlight as recited in claim 1 wherein the transparent lens front section and at least a portion of the opposed side sections are of approximately the same thickness.

18. The flashlight as recited in claim 9 wherein the light emitted from the opposed side positions in the bulb assembly passes outwardly therefrom in a manner that is not obstructed by the tubular housing.

19. The flashlight as recited in claim 9 wherein the transparent lens front section and at least a portion of the opposed side sections are of approximately the same thickness.

* * * * *